US012704266B2

(12) United States Patent
Bariviera et al.

(10) Patent No.: US 12,704,266 B2
(45) Date of Patent: Aug. 11, 2026

(54) APPARATUS FOR COOKING FOOD

(71) Applicant: Elica S.p.A., Fabriano AN (IT)

(72) Inventors: Diego Bariviera, Fabriano AN (IT); Lorenzo Borgiani, Fabriano AN (IT); Fabrizio Crisà, Fabriano AN (IT)

(73) Assignee: Elica S.p.A., Fabriano An (IT)

( * ) Notice: Subject to any disclaimer, the term of this patent is extended or adjusted under 35 U.S.C. 154(b) by 389 days.

(21) Appl. No.: 18/275,432

(22) PCT Filed: Feb. 3, 2022

(86) PCT No.: PCT/IB2022/050943
§ 371 (c)(1),
(2) Date: Aug. 2, 2023

(87) PCT Pub. No.: WO2022/167966
PCT Pub. Date: Aug. 11, 2022

(65) Prior Publication Data

US 2024/0102667 A1 Mar. 28, 2024

(30) Foreign Application Priority Data

Feb. 5, 2021 (IT) ..... 102021000002570

(51) Int. Cl.
*F24C 15/20* (2006.01)

(52) U.S. Cl.
CPC ..... *F24C 15/2042* (2013.01); *F24C 15/2035* (2013.01)

(58) Field of Classification Search
CPC ..... F24C 15/2035; F24C 15/2042
See application file for complete search history.

(56) References Cited

U.S. PATENT DOCUMENTS 3,587,555 A 6/1971 Cerola
3,797,375 A 3/1974 Cerola
(Continued)

FOREIGN PATENT DOCUMENTS

DE 102018130963 6/2020
DE 202020103242 8/2020

OTHER PUBLICATIONS

International search report and written opinion dated May 30, 2022; Application No. PCT/IB2022/050943; 11 pages.

*Primary Examiner* — Ko-Wei Lin
(74) *Attorney, Agent, or Firm* — RANKIN, HILL & CLARK LLP; Erik J. Overberger

(57) ABSTRACT

The present disclosure relates to an apparatus for cooking food comprising: an oven having a cavity and a door associated to a front surface of the cavity and configured to selectively provide access to the inside of the cavity; a hob defining an upper surface of the cooking apparatus comprising at least one heating element; at least one inlet opening provided in said upper surface; at least one outlet opening; a downdraft hood having at least one suction unit configured to suck cooking fumes through said at least one inlet opening and to eject them through said outlet opening; a duct system comprising a first path of cooking fumes such that the sucked fumes flow between the inlet opening and the outlet opening; a filter arranged in the first path of cooking fumes upstream of the suction unit to filter the sucked cooking fumes. A characteristic of the apparatus is that it comprises an extraction/insertion opening provided in said front surface of the cavity of said oven, said extraction/insertion opening being configured to extract/insert said filter, said extraction/insertion opening being accessible when said door allows access to the inside of the cavity of the oven.

13 Claims, 6 Drawing Sheets

(56) References Cited

U.S. PATENT DOCUMENTS

| | | | | |
|---|---|---|---|---|
| 3,954,427 | A | 5/1976 | Jenn | |
| 4,411,254 | A | 10/1983 | Field et al. | |
| 4,766,880 | A * | 8/1988 | von Blanquet | F24C 15/2042 126/299 D |
| 9,869,474 | B2 * | 1/2018 | McEvoy | B01D 46/46 |
| 2021/0156569 | A1 * | 5/2021 | Shingler | B03C 3/08 |

* cited by examiner

APPARATUS FOR COOKING FOOD

TECHNICAL FIELD

The present disclosure relates to an apparatus for cooking food, in accordance with the preamble of claim 1.

In particular, the present disclosure relates to an apparatus for cooking food which integrates an oven, a hob and a hood of the type commercially known as a recessed or downdraft hood.

BACKGROUND ART

In the state of the art there are known apparatuses for cooking food comprising an oven, a hob and a hood for sucking cooking fumes.

In particular, some of such apparatuses have downdraft hoods integrated in the hob or alternatively in the top of a kitchen cabinet where the apparatus for cooking food is housed.

Such a downdraft hood is configured to generate a descending current greater than the ascending speed of the fumes due to cooking so that such fumes are sucked towards an opening provided in the hob itself with motion having a downwards direction.

For example, document U.S. Pat. No. 6,455,818 B1 shows an apparatus for cooking food comprising an oven and a hob arranged vertically above the oven.

Such a hob has a central opening arranged between a plurality of cooking zones and is in fluid communication with a suction unit, positioned below the hob. In use, the suction unit is configured to generate a negative pressure which results in a suction effect of the cooking fumes through the central slot.

Said apparatus for cooking food comprises a filter unit arranged in the slot and vertically removable from the hob to carry out filter cleaning and replacing operations.

Disadvantageously, such a filter unit extends vertically between the hob and the oven thus reducing the useful volume of the cooking chamber of the oven itself.

In other words, the filter unit extending vertically between the hob and the oven prevents making oven cooking chambers which extend vertically up to near the hob. This limits the usability of the oven by the user.

Furthermore, the inlet opening of the fumes, being arranged in a central portion of the hob, reduces the useful surface area thereof usable for cooking food. This reduction of the useful surface cooking area is all the more disadvantageous if the hob is of the "free induction" type, i.e., if the entire surface of the hob can be used for cooking food.

Object of the Disclosure

In this context, an object underlying the present disclosure is to provide an apparatus for cooking food capable of maximising the useful volume and surface area for cooking food.

SUMMARY OF THE DISCLOSURE

In accordance with the present disclosure, the technical task indicated and the specified objects are achieved by an apparatus for cooking food in accordance with one or more of the claims below.

Advantages of the Disclosure

Thanks to the present disclosure, it is possible to provide an apparatus for cooking food having an oven cavity which, with the same installation conditions, allows to maximise the useful volume of the oven's cooking chamber. In particular, this is all the more advantageous if the apparatus of the present disclosure is installed in a modular cabinet of a kitchen having standard dimensions. In fact, in this configuration, thanks to the present disclosure it is possible to dedicate only a part of the available space of the cabinet to the apparatus for cooking food in accordance with the present disclosure while preserving the other parts both in terms of intended use and functionality.

Furthermore, thanks to the present disclosure it is possible to obtain an apparatus for cooking food having a greater useful surface area for positioning the containers containing the food to be heated.

Furthermore, thanks to the present disclosure, the maintenance operations of the filters are easier.

BRIEF DESCRIPTION OF THE DRAWINGS

Further features and advantages of the present disclosure will become more apparent from the description of an exemplary, but not exclusive, and therefore non-limiting preferred embodiment of an apparatus for cooking food, as illustrated in the appended figures, in which.

DETAILED DESCRIPTION

Figure 1A:
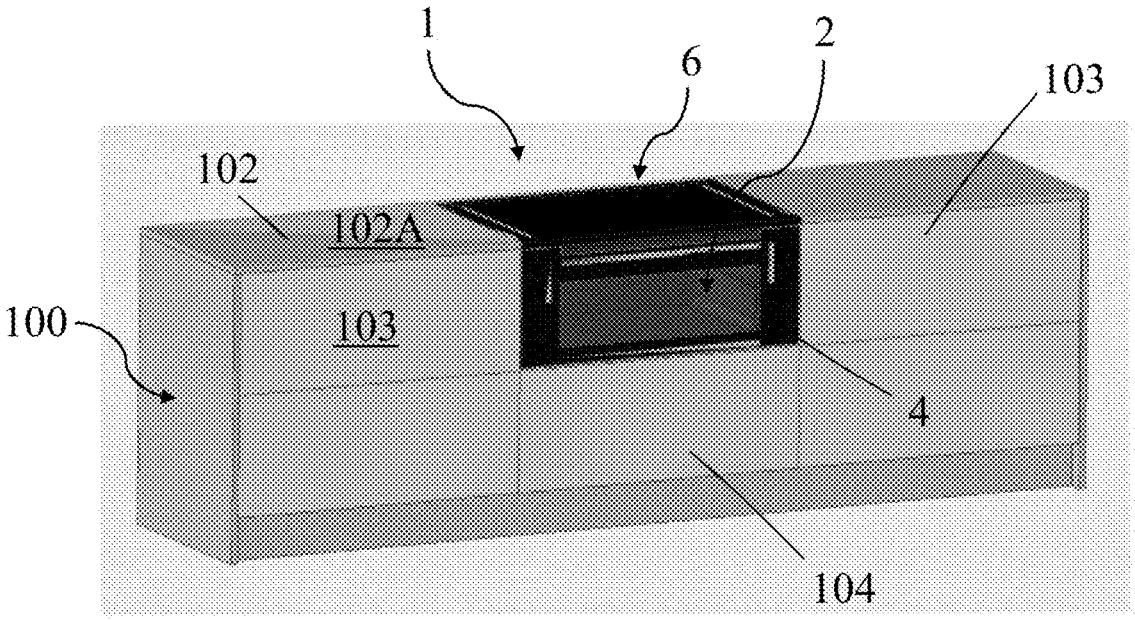
FIG. 1*a* shows a perspective view from the front of an apparatus for cooking food, in accordance with the present disclosure, when the apparatus for cooking food is depicted in a first configuration of use and installed in a modular kitchen cabinet.

Even if not explicitly highlighted, the individual features described with reference to the specific embodiments shall be understood as accessory to and/or interchangeable with other features described with reference to other embodiments.

The present disclosure relates to an apparatus for cooking food, indicated by 1 in the accompanying figures In particular, the cooking apparatus 1 object of the present disclosure is configured to be recessed inside a special compartment 101 of a kitchen cabinet 100 having standard dimensions.

For example, in an embodiment, the compartment can have a height of 360 mm, a width of 900 mm, and a depth which varies as a function of the specific applications.

Preferably, the kitchen cabinet envisages that its compartments are occupied by drawers 103, for example 360 mm tall, arranged on opposite sides of the compartment 101, and a lower drawer 104 arranged vertically below the compartment 101.

In other words, the kitchen cabinet 100 includes the apparatus for cooking food 1 which occupies a compartment of the cabinet 100.

Figure 1B:
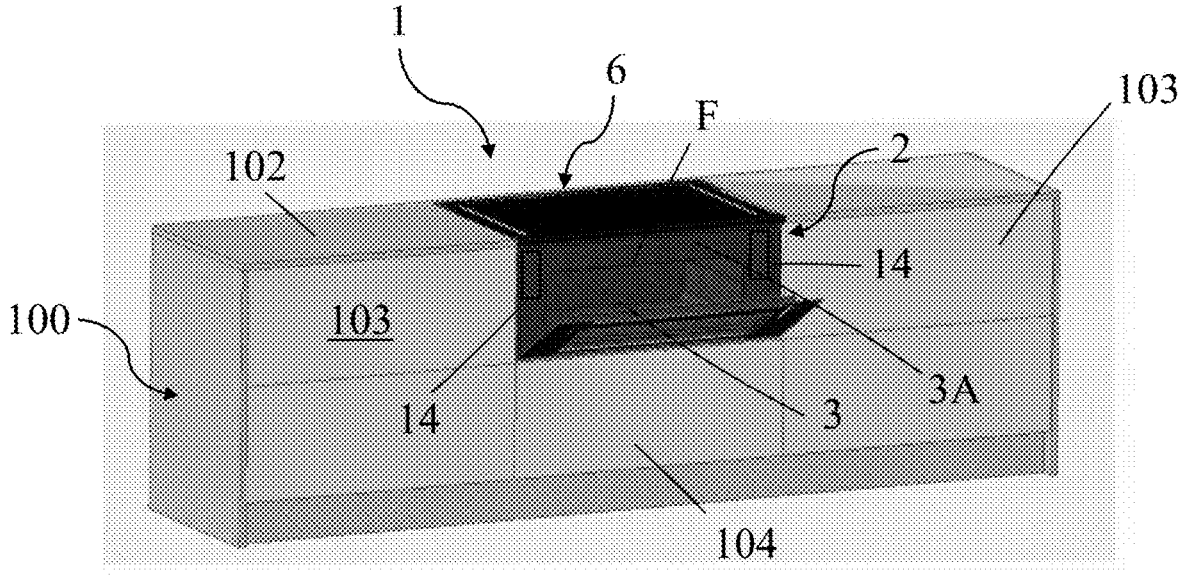
FIG. 1*b* shows a perspective view of the apparatus for cooking food of FIG. 1*a*, where said apparatus for cooking food is depicted in a second configuration of use.

As shown in FIGS. 1*a* and 1*b*, such an apparatus 1 for cooking food comprises an oven 2 having a cavity 3 and a door 4 associated to a front surface 3A of the cavity.

The cavity 3 is configured to accommodate one or more foods to bake therein.

In an embodiment of the present disclosure, and in particular if the apparatus 1 for cooking food is integrated in the kitchen cabinet 100, it is understood that the cavity 3 of the oven 2 has a width equal to 660 mm, a height equal to 210 mm and a depth equal to 405 mm.

The door 4 is configured to selectively provide access inside the cavity 3 of the oven 2 so as to allow the food to be cooked to be loaded and the cooked food to be unloaded.

In detail, such a door 4 is constrained in rotation to the apparatus 1 so as to be able to switch it between a first configuration of use, for example of cooking, in which the door 4 closes the cavity 3 frontally, and a second configuration of use, for example of loading/unloading food, in which the cavity 3 is frontally accessible.

The food loading/unloading configuration will also be indicated hereinafter as a maintenance configuration, as it allows the ordinary maintenance operations to be carried out on some components of the apparatus 1. More details on this will be provided later in the description.

The above-mentioned cooking and loading/unloading (or maintenance) configurations are shown in FIGS. 1*a* and 1*b*, respectively.

The apparatus 1 object of the present disclosure further comprises a hob 6 having a predetermined width "L", length "l" and height "H.

Such a hob 6 defines an upper surface 1A, which limits the apparatus 6 above, and a lower surface 1B, opposite the upper surface 1A.

In particular, when the apparatus 1 is installed in the special compartment 101 of the standard-sized kitchen cabinet 100, the upper surface 1A represents the visible or in-view side for the user while the lower surface 1B represents the surface hidden from the user's view, for example because it is recessed.

Figure 2:
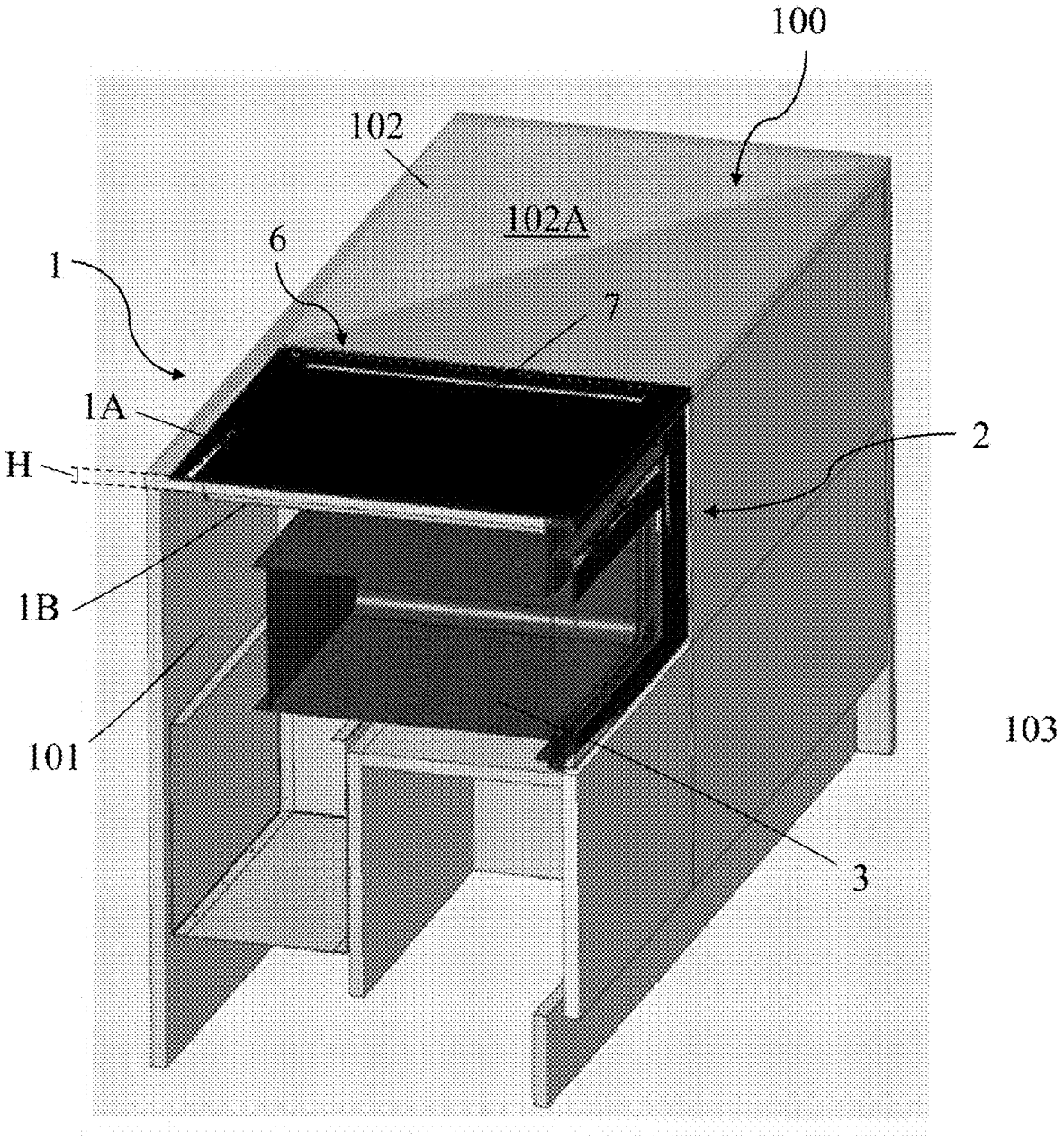
FIG. 2 shows a perspective section view from the side of the apparatus for cooking food of FIG. 1*a;*

Preferably, when the apparatus 1 is installed the surface 1A is arranged seamlessly (i.e., continuously, uninterruptedly) with an outer surface 102A of a top 102 of the kitchen cabinet 100, as shown in FIG. 2 and in FIG. 1*a*.

The hob 6 comprises at least one heating element 7 at which a container containing the food to be heated is available.

Preferably, the hob 6 comprises a plurality of heating elements 7 suitably distributed on the upper surface 1A and, in particular, capable of transmitting energy to the bottom of the containers in which the food to be heated is kept.

In a preferred embodiment, the at least one heating element 7 is embodied in a resistive, or gas or, preferably, inductive heating element.

Furthermore, the plurality of heating elements can be distributed on the upper surface 1A by means of a plurality of micro-inductors homogeneously distributed throughout the entire hob 6.

Typically, the upper surface 1A is embodied in a sheet of glass or material having similar properties.

The apparatus 1 object of the present disclosure further comprises at least one inlet opening 8 on the upper surface 1A of the hob 6.

In detail, the inlet opening 8 extends between the upper surface 1A and the lower surface 1B through the entire height "H" of the hob 6. The inlet opening 8 thus takes the form of a through hole in the hob 6.

Preferably, the inlet opening 8 is rectangular in shape and one of its two dimensions is much larger with respect to the other. Preferably its smaller dimension is between 2-3.5 cm.

Figure 3:
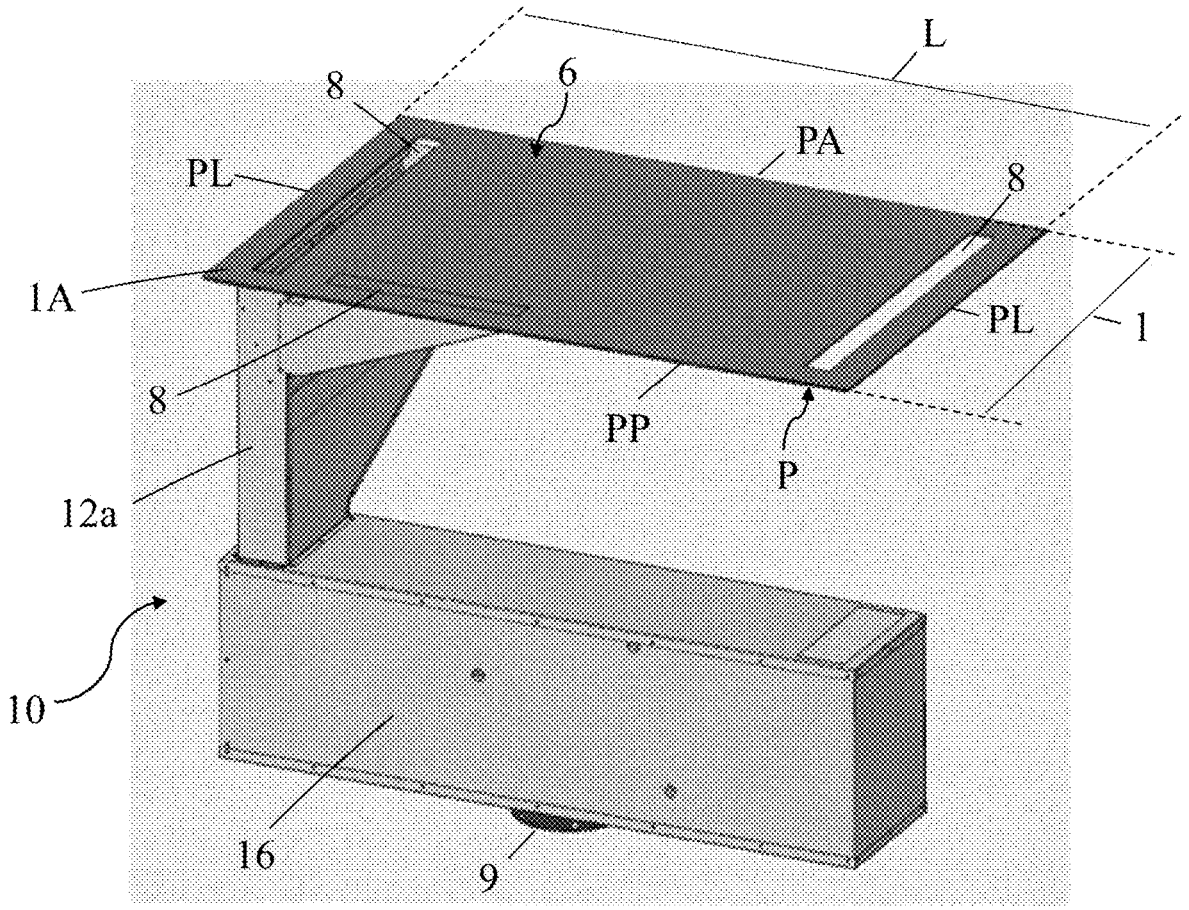
FIG. 3 shows a perspective view from the back of some components of the apparatus for cooking food of FIG. 1*a;*

Preferably, as shown in FIG. 3, the apparatus 1 comprises two or more inlet openings 8 each of which is arranged near a respective perimeter edge P of the hob 6.

In greater detail, the perimeter edge P comprises two side edges PL, which extend along the length "l" of the hob 6, a front edge PA extending along the width "L" of the hob 6 at the oven door 4, and a rear edge PP extending along the width "L" of the hob 6 opposite the front edge.

It should be specified that the inlet openings can extend along the length "l" of the hob at both side edges, and along the width "L" only at the rear edge.

The apparatus 1 further comprises an outlet opening 9 in fluid communication with the at least one inlet opening 8.

Such an outlet opening 9 represents the ejection point of the sucked fumes.

Figure 4:
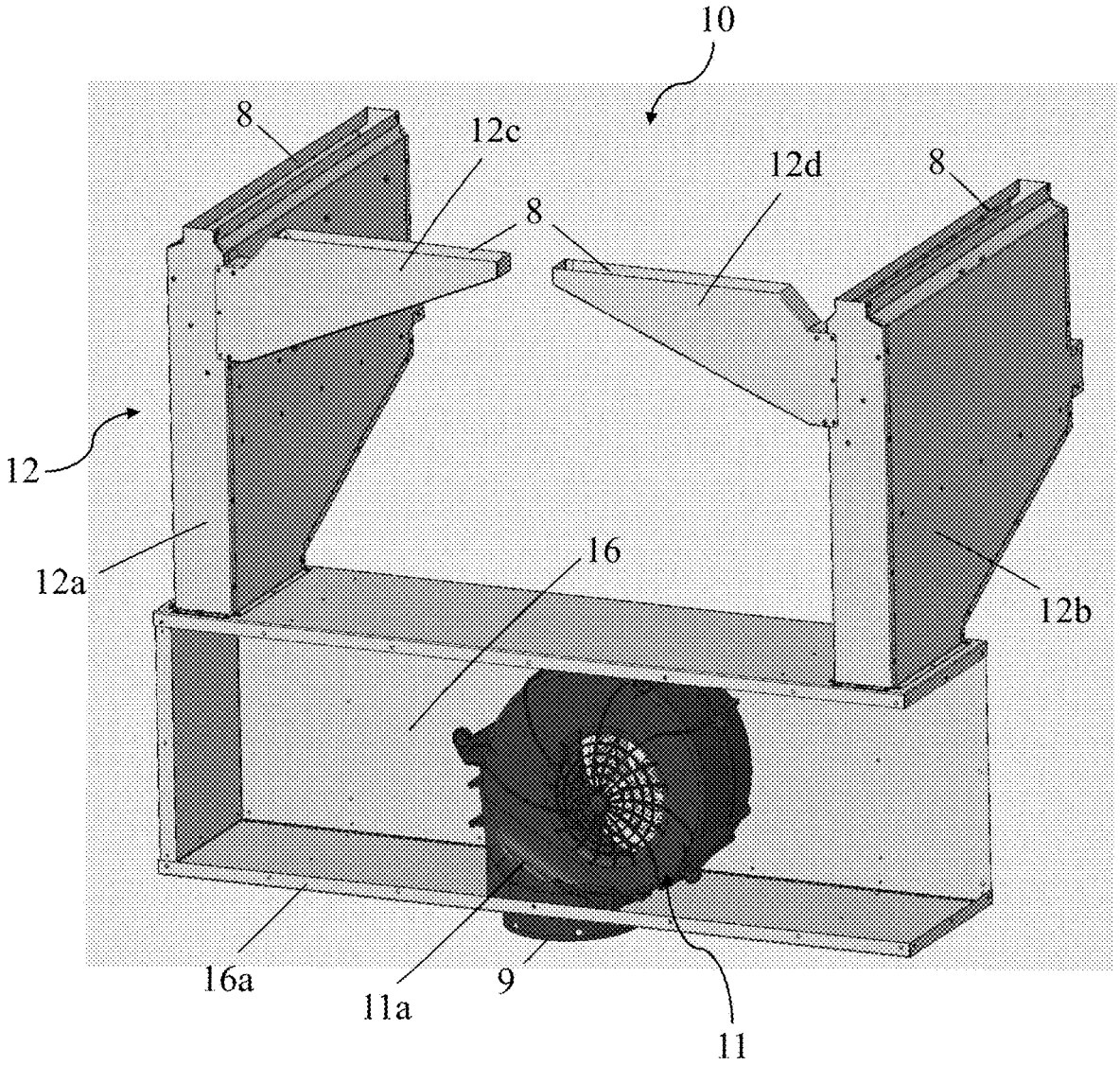
FIG. 4 shows a perspective view from the back of FIG. 3 some parts of which have been removed to better illustrate others.

As shown in FIG. 4, the apparatus 1 comprises a downdraft-type hood 10.

Preferably, the downdraft-type hood 10 can be operated in suction or filtering mode. In greater detail, in suction mode the hood 10 is configured to eject the cooking fumes in an environment outside the room in which the hood 10 is arranged, preferably an open environment, while in filtering mode the hood 10 ejects the cooking fumes inside the room in which the hood 10 is arranged.

Such a downdraft hood 10 has one or more suction units 11 each of which is configured to suck the cooking fumes through the at least one inlet opening 8 and to eject them through a respective outlet opening 9.

The suction unit 11 is configured to generate a negative pressure (less than atmospheric) responsible for the suction effect of the cooking fumes through the at least one inlet opening 8.

Preferably, the suction unit 11 comprises a conveyor 11*a* adapted to channel the cooking fumes.

Preferably, as shown in FIGS. 3 and 4, the apparatus 1 object of the present disclosure comprises a suction chamber 16 inside which the suction unit is arranged. Even more preferably, said suction chamber 16 contains the conveyor 11*a* entirely therein.

Even more preferably, said suction chamber 16 comprises a bottom 16*a* shaped to collect fluids such as water/grease flowing from the inlet opening 8. For example, the bottom can comprise a liquid collection basin (not shown) which can be removed from the suction chamber 16, or it can have a drainage tap (not shown) accessible by a user and arranged at a liquid collection cavity so as to allow the liquid accumulated therein to be emptied.

It should be specified that to fulfil the function of collecting the fluids, the bottom must prevent them from flowing out of the outlet opening 9 or from the openings if there are two suction units 11. To this end, a rib of predetermined height projecting from the bottom of the suction chamber 16 is included, which extends between the rear and front edge of the chamber itself along a direction perpendicular to both edges.

As shown in FIGS. 3 and 4, the apparatus 1 comprises a duct system 12 comprising a first path of cooking fumes 12*a*. The sucked cooking fumes flowing along the first path of cooking fumes 12*a* flow between the at least one inlet opening 8 and the outlet opening 9.

In other words, the first path of cooking fumes 12*a* fluid-dynamically connects the inlet opening 8 and the outlet opening 9.

According to an aspect the duct system 12 is made of metallic material to better resist the heat emanating from the cavity 3 of the oven 2 during its operation. However, other suitable materials can be used instead of metallic.

If the apparatus object of the present disclosure comprises two inlet openings extending at the side edges PL of the hob 6, the duct system 12 comprises a path of the cooking fumes for each inlet opening 8. That is, the duct system 12 comprises a first and a second path of cooking fumes 12*a*, 12*b* each of which is associated to a respective inlet opening but with the same outlet opening.

In this case in which the apparatus object of the present disclosure comprises two inlet openings 8, the first and second paths of cooking fumes 12*a*, 12*b* are in fluid communication with the suction chamber upstream of the suction unit 11.

If the apparatus object of the present disclosure comprises one or two further inlet openings 8 at the rear edge PP of the hob 6, in addition to the two inlet openings 8 extending at the side edges PL, said duct system 12 comprises a third and a fourth path of cooking fumes 12*c*, 12*d* respectively in fluid communication with the first and second path 12*a*, 12*b*. Such third and fourth paths of cooking fumes 12*c*, 12*d* are configured to conduct the sucked cooking fumes through the further inlet openings 8 to the outlet opening, through the first and second path of cooking fumes 12*a*, 12*b*.

Figure 5:
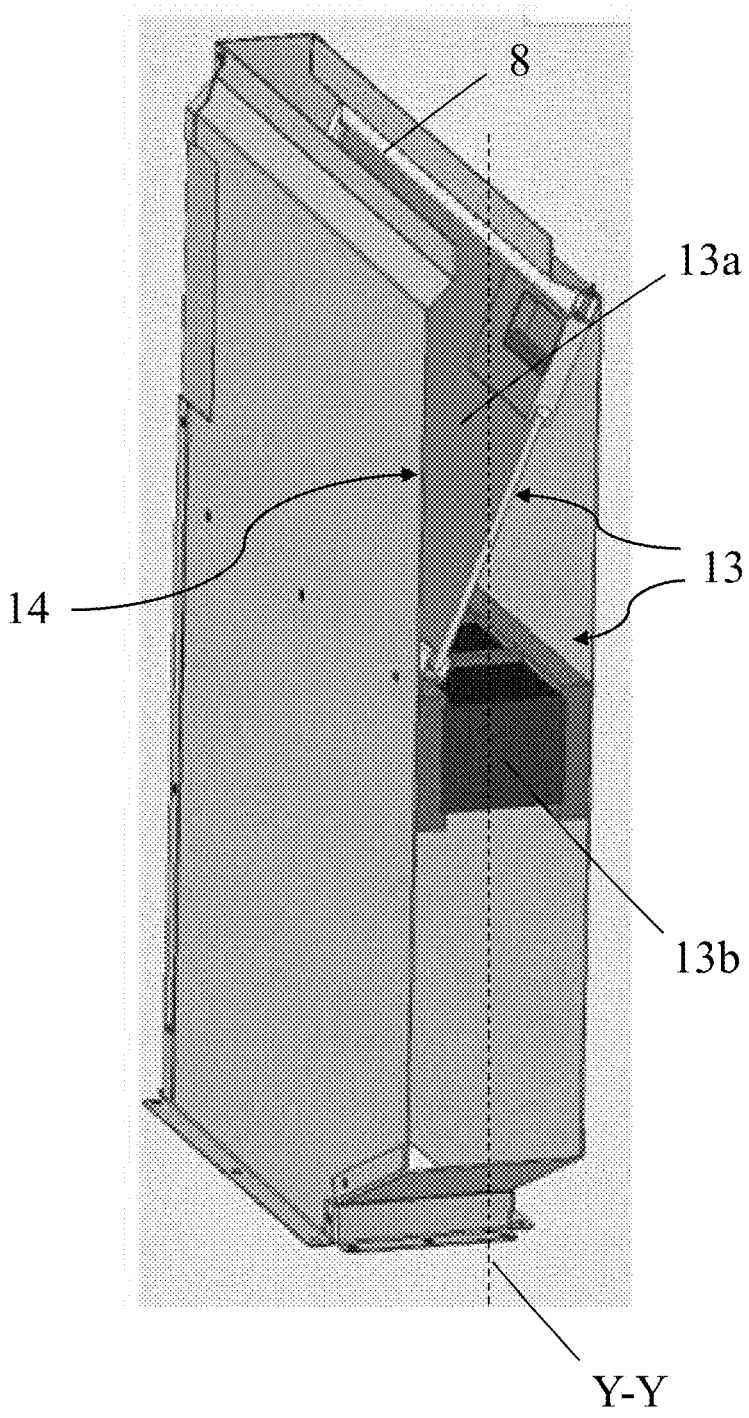
FIG. 5 shows a perspective view from the front of some components of the apparatus for cooking food of FIG. 1*a;*

As shown in FIG. 5, the apparatus 1 comprises a filter 13 for filtering the sucked cooking fumes.

Such a filter 13 is arranged in the first path of cooking fumes 12*a* of the duct system 12, in particular upstream of the suction unit 11.

Therefore, in use, the cooking fumes, once sucked through the at least one inlet opening 8 by the suction effect generated by the suction unit 11, then proceed along the first path of cooking fumes 12*a* passing through the filter 13 to thus reach the suction unit 11 and then the outlet opening 9.

It should be specified that if there are two inlet openings extending at the side edges PL, the second path of cooking fumes 12*b* comprises a respective filter 13 adapted to filter the cooking fumes flowing between the respective inlet openings 8 and the outlet opening 9. Therefore, in this case part of the cooking fumes will flow along the first path 12*a* and part along the second path 12*b* to then reach the suction unit 11 and then the outlet opening 9

What is said for the first path of cooking fumes 12*a* below will be equally valid for the second path of cooking fumes 12*b* in the case in which the apparatus object of disclosure comprises two inlet openings 8 extending at the side edges PL.

If the third and fourth paths of cooking fumes 12*c*, 12*d* are present, they are connected to the first and second paths of cooking fumes 12*a*, 12*b* upstream of the respective filters 13, respectively.

As shown in the sectional view of the first path of FIG. 5, the duct 12 in which the filter is arranged is shaped to create a shape coupling with such a filter.

Preferably, the filter comprises a grease filter 13*a* configured to filter the greases present in the cooking fumes.

Still more preferably, the grease filter and is arranged transversely to a main extension direction Y-Y of the first path of cooking fumes 12*a* so as to maximise the surface of the grease filter 13*a* exposed to the cooking fumes flow.

It should be specified that the grease filter is arranged in the duct so as to occupy the entire section, so that the entire flow is filtered.

For example, the grease filter 12*a* is made of a metal grille (or other material having similar features) retained by a metal or plastic profile arranged peripherally to the grille.

Still more preferably, the filter 13 comprises an odour filter 13*b* configured to filter the molecules responsible for the odours of the cooking fumes, eliminating them.

In detail, as shown in FIG. 5, said odour filter 13*b* is arranged downstream of the grease filter 13*a*, i.e., the flow of cooking fumes passes first through the grease filter 13*a* and then through the odour filter 13*b*.

It should be specified that the odour filter 13*b* as well as the grease filter 13*a* is arranged in the duct so as to occupy the entire section thereof, so that the entire flow is filtered.

According to an aspect, the odour filter 13*b* comprises a set of filters housed in respective cavities of a filter holder element 131 extending along a main extension direction A-A.

For example, the odour filter 13*b* is an activated carbon filter.

In an embodiment the grease filter 13*a* and the odour filter 13*b* are constrained together so as to be removable/insertable as a single filter.

In the embodiment shown in the accompanying figures, the grease filter 13*a* is separate and distinct from the odour filter 13*b*, i.e., each grease and odour filter is removable/insertable independently of the other, i.e., they are individually movable.

As certainly known to those skilled in the art, the suction hood filters of cooking fumes require ordinary maintenance operations which typically involve the cleaning/replacement of filters.

It is therefore evident that the user needs to be able to access the filter 13 in order to carry out such routine maintenance operations.

In greater detail, as shown in FIG. 1*b*, the apparatus 1 comprises an extraction/insertion opening 14 configured to allow the extraction and insertion of the filter 13 inside the first path of cooking fumes 12*a*.

In particular, the extraction/insertion opening 14 is sized to allow the extraction and insertion of the filter 13 inside the first path of cooking fumes 12*a*.

Such an extraction/insertion opening 14 is arranged on the front surface 3A of the cavity 3 of the oven 2, and the filter 13 is removable/insertable along a direction perpendicular to said front surface 3A.

It should be noted that such filter extraction/insertion operations 13 can only be carried out when the door 4 allows access to the oven cavity, i.e., when it is in the maintenance configuration. In fact, as shown in FIG. 1*a*, when the door 4 is in the cooking configuration, the extraction/insertion opening 14 is inaccessible, as it is covered by the door itself.

Preferably, this extraction/insertion opening 14 is arranged laterally with respect to a perimeter contour F which surrounds an access mouth to the cavity 3 of the oven 2 on the front surface 3A.

Even more preferably, said extraction/insertion opening 14 is rectangular in shape and extends along a vertical direction at the filter 13, so as to allow the user to move the filter to and from the duct of the first path of fumes 12*a*.

The extraction/insertion opening 14 can extend along the vertical direction Y-Y at both the grease filter 13*a* and the odour filter 13*b*, so as to allow the user to grasp and move them both or individually to and from the duct 12 in which they are housed.

In this case the opening 14 defines a surface, for example equal to 65×190 mm.

In a preferred embodiment, the extraction/insertion opening 14 extends along the vertical direction Y-Y only at the odour filter 13*b* so as to extract only the odour filter.

In this case the opening 14 defines a surface, for example equal to 65×50 mm.

It should be noted that if the extraction/insertion opening 14 extends along the vertical direction Y-Y only at the odour filter 13*b*, then it is possible for the grease filter 13*a* to be extracted from the inlet opening 8 along a direction perpendicular to the hob, i.e., substantially parallel to the vertical direction Y-Y.

Preferably, the apparatus 1 object of the present disclosure comprises closing members 15 associated to the extraction/insertion opening 14 to tightly close it.

In other words, in use, the closing members 15 are shaped to hermetically plug the extraction/insertion opening 14 so as to prevent the creation of an air flow through the extraction/insertion opening 14, at least when the door 4 of the oven 2 is in the cooking configuration.

It should be noted that the closing members 15 have a surface which must be at least equal to or greater than that of the extraction/insertion opening 14.

In a first embodiment of the apparatus object of the present disclosure, the closing members 15 are associated to the door 4 of the oven 2.

In detail, the oven door 4 comprises a surface adapted to close the extraction/insertion opening 14 when the door 4 closes the cavity 3 of the oven 2, i.e., when the apparatus is in the cooking mode.

In other words, in the first embodiment, the extraction/insertion opening 14 is closed by switching the oven door 4 from the food loading/unloading configuration to the cooking configuration.

It should be specified that if both the first and second path for sucking fumes 12*a*, 12*b* are present, there will be two extraction/insertion openings 14 which will be closed simultaneously when the door 4 closes the cavity 3 of the oven 2.

In a second embodiment of the apparatus object of the present disclosure, the closing members 15 are associated to the front surface 3A by pressure or hinging.

In other words, in the second embodiment, the closing members 15 are a sort of 'cap' which snaps into the front surface 3A to close the extraction/insertion opening 14.

In this embodiment, the closing members 15 can be hinged to the front surface 3A, so that by rotating with respect to the front surface they are arranged at the extraction/insertion opening 14 to close it.

In a third embodiment of the apparatus object of the present disclosure, the closing members 15 are associated to a head end 130 of the filter 13 which, abutting against the extraction/insertion opening 14, when the filter is housed in the duct 12, is able to completely close it.

It should be specified that, in this scenario, both the odour filter 13*b* and the grease filter 13*a* comprise a relative closing surface arranged at a head end adapted to close the extraction/insertion opening 14, when the filter 13 is housed in the duct 12.

Figure 6A:
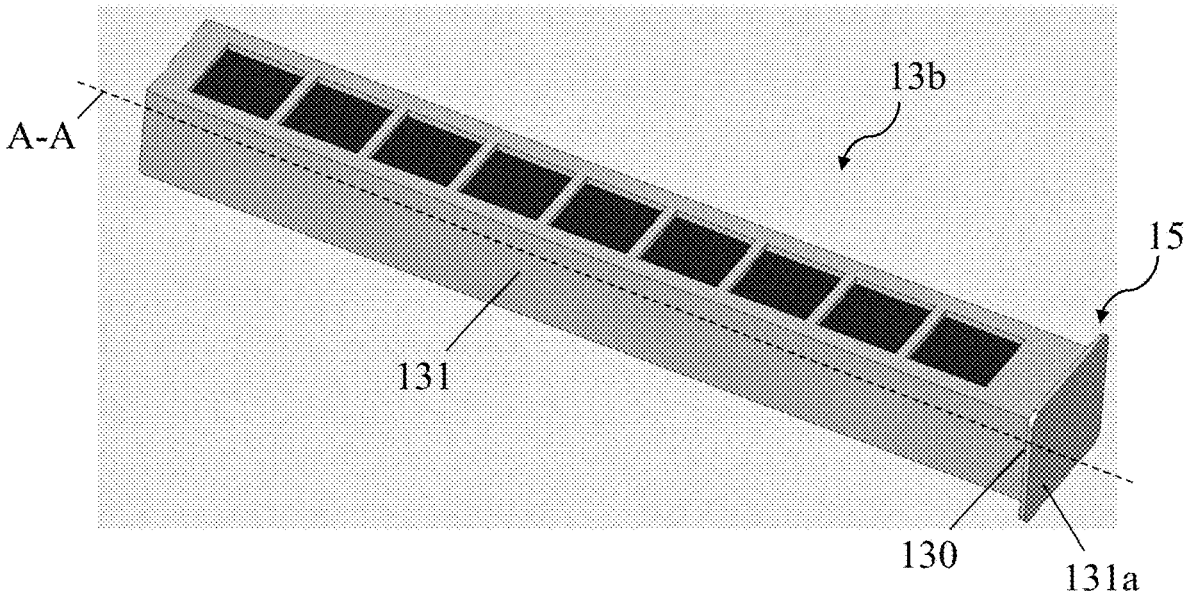
FIG. 6*a* shows a perspective view from the side of a component of the apparatus for cooking food of FIG. 1*a;*
Figure 6B:
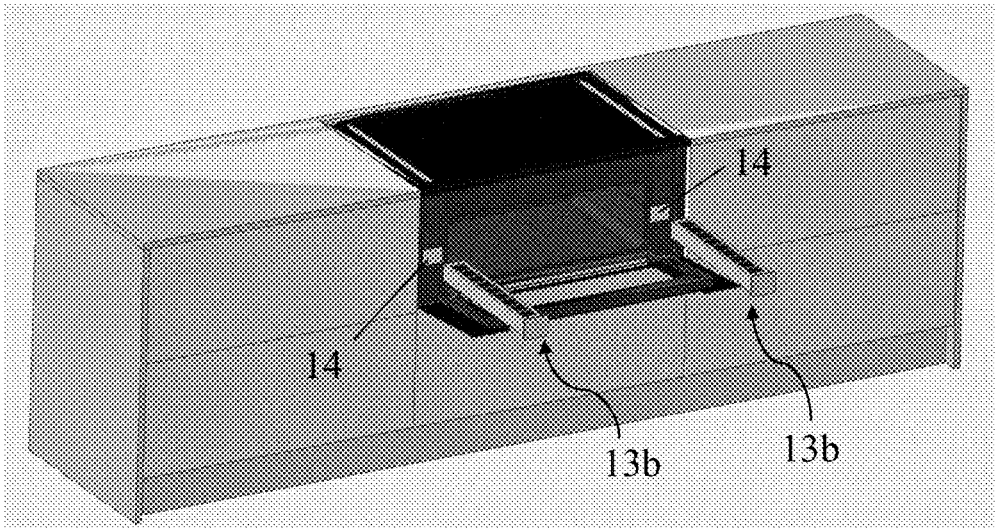
FIG. 6*b* shows how the component of FIG. 6*a* is inserted in the apparatus of FIG. 1*a*.

In a preferred embodiment, as shown in FIGS. 6*a* and 6*b*, the closing members 15 comprise a closing surface 131*a* arranged at the head end 130 of the odour filter 13*b* only.

Such a head end 130 is oriented transversely, preferably orthogonally, to the main extension direction A-A of the filter holder 131.

In such a preferred embodiment, the relative closing surface 131*a* arranged at a head end 130 of the odour filter 13*b* is adapted to close the extraction/insertion opening 14, when the filter 13*b* is housed in the duct 12.

In other words, in the aforementioned preferred embodiment, the closing members 15 are associated only with the head end 130 of the odour filter 13*b* while the grease filter 13*a* lacks them.

Therefore, again in the aforementioned preferred embodiment, the odour filter 13*b*, by means of the relative closing surface 131*a* arranged at a head end 130, plugs the opening 14 and is removable/insertable through such an opening 14 while the grease filter 13 is removable/insertable from the respective inlet opening 8 (in the case of two or more inlet openings).

Clearly, in order to satisfy contingent and specific needs, a person skilled in the art may make numerous modifications and variants to the configurations described above. Such modifications and variations are all also contained within the scope of the disclosure, as defined by the following claims.

The invention claimed is:

1. An apparatus for cooking food comprising:

an oven having a cavity and a door associated to a front surface of the cavity and said door being configured to selectively provide access to the inside of the cavity of the oven;

a hob comprising at least one heating element, the hob defining an upper surface of the cooking apparatus;

at least one inlet opening provided in said upper surface of the hob;

at least one outlet opening;

a downdraft hood having at least one suction unit configured to suck cooking fumes through said at least one inlet opening and to eject them through said at least one outlet opening;

a duct system comprising a first path of cooking fumes such that the sucked fumes flow between the at least one inlet opening and the at least one outlet opening;

a filter unit for filtering the sucked cooking fumes, said filter unit being arranged in said first path of cooking fumes, said filter unit being arranged upstream of said suction unit; and an extraction/insertion opening provided in said front surface of the cavity of said oven, said extraction/insertion opening being sized so as to extract/insert said filter unit, said extraction/insertion opening being accessible when said door allows access to the inside of the cavity of the oven.

2. The apparatus for cooking food according to claim 1, further comprising closing members associated to said extraction/insertion opening to tightly close said extraction/insertion opening.

3. The apparatus for cooking food according to claim 1, wherein said filter unit comprises a grease filter.

4. The apparatus for cooking food according to claim 3, wherein said filter unit comprises an odour filter, said odour filter being arranged downstream of said grease filter.

5. The apparatus for cooking food according to claim 1, comprising at least two inlet openings each of which is arranged near a respective perimeter edge of the hob.

6. The apparatus for cooking food according to claim 2, wherein said closing members are associated to said door of the oven.

7. The apparatus for cooking food according to claim 2, wherein the filter unit comprises a head end adapted to abut against the extraction/insertion opening to close it when the filter unit is inserted in the duct.

8. The apparatus for cooking food according to claim 1, comprising a suction chamber inside which the at least one suction unit is arranged.

9. The apparatus for cooking food according to claim 5, wherein said duct system comprises a second path of cooking fumes so that the sucked fumes flow between a respective inlet opening and said at least one outlet opening.

10. The apparatus for cooking food according to claim 9, wherein the second path of cooking fumes comprises a respective filter unit adapted to filter the cooking fumes flowing between the respective inlet opening and said at least one outlet opening.

11. The apparatus for cooking food according to claim 9, wherein the first and second path of cooking fumes are in fluid communication with a suction chamber upstream of said at least one suction unit.

12. The apparatus for cooking food according to claim 10, wherein said duct system comprises a third and fourth path of cooking fumes respectively in fluid communication with the first and second path of cooking fumes upstream of the respective filter unit.

13. The apparatus for cooking food according to claim 8, wherein the suction chamber comprises a bottom adapted to collect water/grease flowing through said at least one inlet opening.

* * * * *